US005273214A

United States Patent [19]

Huffstutler

[11] Patent Number: 5,273,214

[45] Date of Patent: Dec. 28, 1993

[54] PORTABLE COOLING DEVICE

[76] Inventor: Randall L. Huffstutler, 224 Vance Pl., Gadsden, Ala. 35901

[21] Appl. No.: 946,854

[22] Filed: Sep. 18, 1992

[51] Int. Cl.[5] ..... B05B 15/06

[52] U.S. Cl. ..... 239/279; 239/273

[58] Field of Search ..... 239/273, 275, 276, 279, 239/280, 285; 248/76, 80, 83

[56] References Cited

U.S. PATENT DOCUMENTS

| | | | |
|---|---|---|---|
| 483,017 | 9/1892 | Rigby | 239/279 |
| 2,210.180 | 8/1940 | Richardson | 239/279 |
| 4,498,627 | 2/1985 | Arginsky | 239/279 |
| 4,519,544 | 5/1985 | Szabo | 239/279 |
| 4,883,228 | 11/1989 | Vydrzal et al. | 239/279 |
| 5,152,459 | 10/1992 | Boeh | 239/273 |

FOREIGN PATENT DOCUMENTS

| | | | |
|---|---|---|---|
| 1364485 | 5/1964 | France | 239/275 |
| 2105615 | 3/1983 | United Kingdom | 239/279 |

*Primary Examiner*—Andres Kashnikow
*Assistant Examiner*—Lesley D. Morris
*Attorney, Agent, or Firm*—Phillips & Beumer

[57] ABSTRACT

A cooling apparatus is provided having a hollow, tubular base, with a tubular member extending upwardly therefrom. A fogging nozzle is mounted at an upper end of said tubular member and receives pressurized water and provides a fine fog of cooling water droplets. An adjustable valve admits water from a pressurized source to the base, stabilizing the base, and also admitting water to the nozzle.

1 Claim, 1 Drawing Sheet

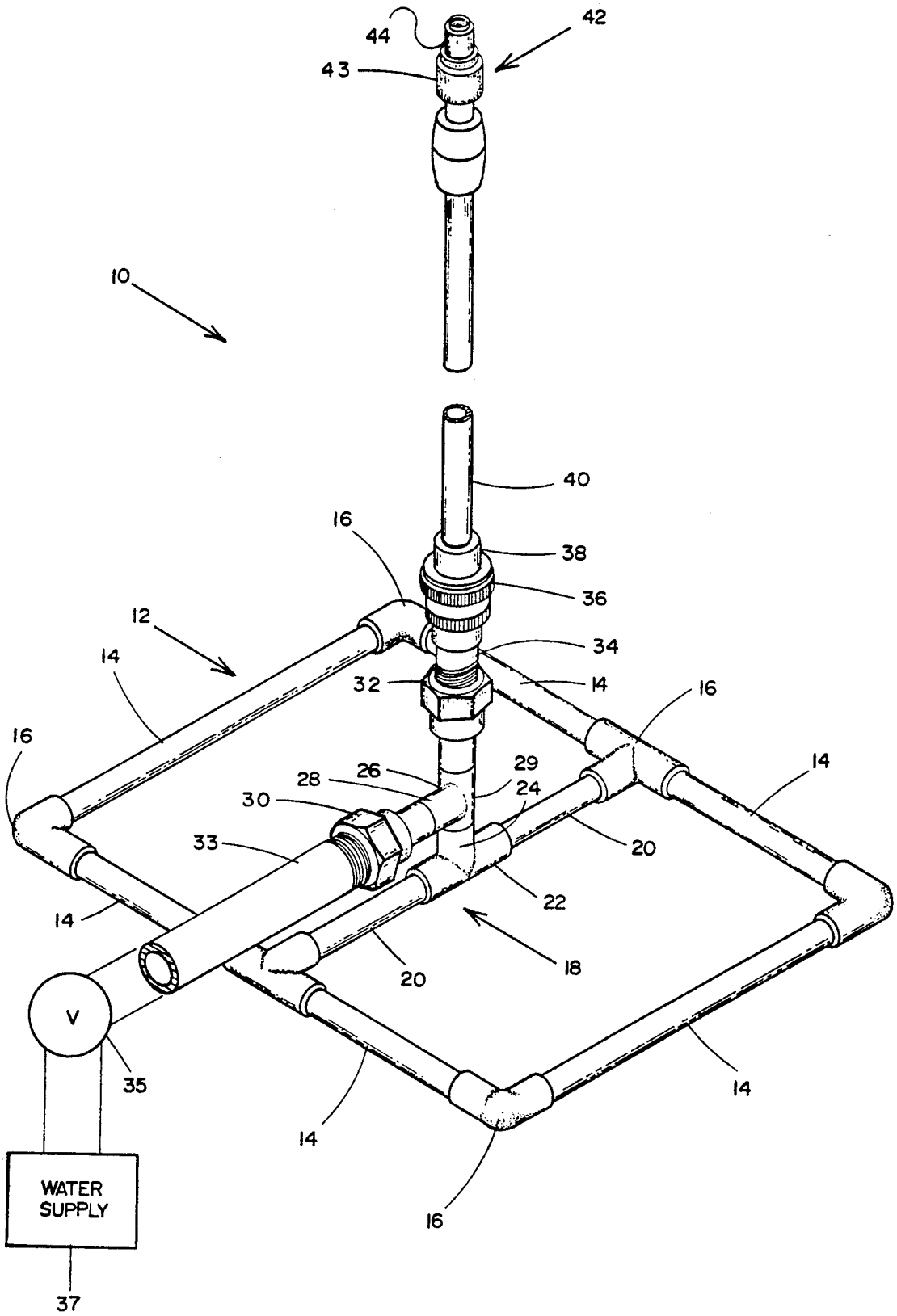
44
42
43
10
40
16
38
36
12
34
14
32
14
16
16
14
28
26
29
30
24
33
20
22
14
18
20
V
35
14
14
16
WATER SUPPLY
37

PORTABLE COOLING DEVICE

FIELD OF THE INVENTION

This invention relates generally to portable devices for providing a cooling fog and particularly to such a device for providing a cooling fog used outdoors by athletes and sunbathers.

BACKGROUND OF THE INVENTION

During the warmer days of the year, typically the summer season, those pursuing outdoor activities tend to become overheated. When this occurs, one may take a shower, rest in the shade, or direct a spray of water onto oneself. In the latter instance, the spray of water is generally from a hose coupled to a source of water, with the hose having a nozzle or like device for dispensing a spray of water. However, such a spray of water may be undesirable due to force of impact of larger water droplets and thermal shock effects due to a large temperature difference between water generally available from a pipe that runs underground and body temperature.

Nozzles exist for providing a fog or mist for the purpose or humidifying air and plants inside greenhouses and are designed to be fixed in a network of permanently mounted pipes in the greenhouse. These nozzles are designed to produce tiny droplets that evaporate quickly and are generally unsuitable for use outdoors irrigating crops because the tiny droplets tend to evaporate before reaching the plant or ground. Nozzles also exist for irrigation purposes and produce a much larger droplet sized to minimize evaporation so that as much water as possible reaches the plant or ground.

Neither of these arrangements are truly satisfactory for cooling an overheated individual in an outdoor situation, as the greenhouse application lacks portability and cannot be conveniently disassembled for transportation and storage. The nozzles for irrigation purposes also may not be readily disassembled for transportation and storage and further produce the larger droplets, which are undesirable as described in the foregoing.

Accordingly, it is an object of this invention to provide a portable cooling apparatus which uses, as a coolant, water dispersed as a fog and which may be conveniently disassembled for transportation and storage.

SUMMARY OF THE INVENTION

A portable, outdoor cooling apparatus is provided having a tubular base for receiving water, weighting the base, and providing stabilization to the apparatus. A horizontal tubular support member is coupled to the base, with a coupling extending vertically from the support member. A tubular member is provided with a mating coupling at a lower end, so that the tubular member may be conveniently coupled to the base. At the upper end of the tubular member is mounted a nozzle for dispensing a fog of water droplets. A source of pressurized water is connected to the base and the tubular member, with an adjustable valve mounted between the apparatus and source of pressurized water to control flow of water to the apparatus.

BRIEF DESCRIPTION OF THE DRAWING

The single drawing of the invention is a perspective view illustrating construction of the invention.

DESCRIPTION OF THE PREFERRED EMBODIMENT

Referring to the single drawing, a cooling fogger apparatus 10 of the present invention is shown. Here, by way of example, a base 12 is constructed of conventional polyvinyl chloride (PVC) piping 14 and fittings 16, or other pipings and fittings constructed of a suitable material, and as shown, is constructed in a square or rectangular configuration. A centrally located support member 18 is constructed of piping 20 and a T fitting 22, with a second T fitting 26 coupled proximate fitting 22. Fitting 26 is mounted so that a single leg 28 thereof extends generally horizontally, with leg 28 coupled to a fitting 30 to which is mounted a hose 33.

An infinitely variable valve 35 is mounted in line with hose 33 and proximate base 12 for convenient operation by the user and regulates flow and pressure of water to fogger 10 from source 37. Significantly, fitting 26 communicates with interior regions or base 12, allowing water access thereto and providing a weighted base in order to lend stability to fogger 10. An upwardly extending leg 29 of fitting 26 is coupled to a threaded fitting 32, into which is threaded a fitting 34, which in turn supports a metallic female threaded coupling 36, as is typically found on garden hoses. A mating, metallic male coupling 38 is threaded into coupling 36 and supports a vertically depending pipe 40 of any practical length, with lengths of between about two to six feet being preferred.

Fittings 32, 34, 36, 38 and pipe 40 are all in communicating relation with fitting 26. Couplings 36 and 38 allow for convenient disassembly of fogger 10 for transportation and storage.

Mounted at a top portion 42 of pipe 40 is a cap 43 having an opening (not shown) which is preferably threaded to receive a threaded, tubular portion of a fogging nozzle 44 through which water is communicated to nozzle 44. Alternately, the tubular portion of nozzle 44 may be smooth and pressed into a smooth opening of cap 43 and held in place by an interference fit.

Nozzle 44 is of a type sold by Plastro Irrigation, Inc., of Suisun, Calif., under the trade name of "TORNADO MIST SPRAYER." This nozzle is designed to produce and disperse a fog of water droplets having an average diameter of about 0.006" at a flow rate of 5.5 gallons/-hour at 40 psi water pressure, with this flow rate and pressure producing a fog over a circular area or about five feet in diameter.

This nozzle is of the type used to humidify greenhouses and in general has very limited outdoor uses due to the small droplet size produced thereby. This nozzle 44 does not produce a spray of larger droplets of water, in contrast to the wide variety of water toys used by children and other typical sprayers used to spray sunbathers or athletes today.

Such a spray of larger droplets, for a sunbather, is undesirable inasmuch as larger droplets tend to carry an impact shock effect due to impact of the larger drops against the skin and a thermal shock effect due to a large temperature difference between temperature of the larger drops and both ambient temperature and overheated skin of the sunbather.

Additionally, the fog produced by nozzle 44 attenuates ultraviolet radiation, decreasing incidence of overexposure to such radiation from the sun when used on a continuous basis. Further, as this nozzle emits water at a low flow rate, only 5.5 gallons/hour at 40 psi, the apparatus may be operated for hours without using large amounts of water.

In use, the cooler is assembled by threading male fitting 38 into female fitting 36 and tightening the connection between these fittings. Valve 35 is then coupled to a pressurized source 37 of water, as by a garden hose or direct connection to a water spigot, and valve 35 opened. Initially, water is admitted into base 12, stabilizing cooler 10, after which valve 35 may be adjusted so that nozzle 44 is producing a fog over a circular area of about five feet. A sunbather or overheated athlete may then stand or lay in or under this fog so as to become cooled thereby.

Having thus described my invention and the manner of its use, it is apparent that minor modifications may be made thereto that fairly fall within the scope of the following appended claims, wherein I claim:

1. A portable cooling apparatus comprising:

a tubular, hollow, rectangular base assembly;

a tubular, hollow support member centrally extending between opposed sides of said base assembly and in communicating relation with said base assembly;

an upwardly extending, first fitting centrally located in said support member, said fitting having a first, upwardly extending, sealable coupling and a second, horizontally extending fitting;

a tubular member having lower and upper ends, said lower end having a second coupling adapted to be sealably mated to said first coupling and in communicating relation with said base assembly and said support member, said first and second couplings disposed for assembly and disassembly of said tubular member to and from said first fitting;

a nozzle mounted at said upper end of said tubular member, said nozzle disposed for receiving pressurized water and providing a fog of water droplets having an average size or approximately 0.006" at a flow rate of approximately 5.5 gallons per hour at about 40 psi;

a pressurized source of water; and an infinitely variable valve connected to said second fitting and disposed for connection to said pressurized source of water, whereby, as said valve is opened, said water enters said base assembly, providing weight and stabilization thereto, and said water is applied to said nozzle, which provides said fog as a coolant.

* * * * *